US012680399B2

(12) United States Patent
Rolovic

(10) Patent No.: US 12,680,399 B2
(45) Date of Patent: Jul. 14, 2026

(54) COILED TUBING DEPLOYMENT/RETRIEVAL APPARATUS, A COILED TUBING SURFACE EQUIPMENT SPREAD, AND METHOD THAT EMPLOY A POWER CABLE INJECTOR

(71) Applicant: Halliburton Energy Services, Inc., Houston, TX (US)

(72) Inventor: Radovan Rolovic, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/186,005

(22) Filed: Apr. 22, 2025

(65) Prior Publication Data

US 2025/0382851 A1 Dec. 18, 2025

Related U.S. Application Data

(60) Provisional application No. 63/665,709, filed on Jun. 28, 2024, provisional application No. 63/659,767, filed on Jun. 13, 2024.

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 5,180,014 A 1/1993 Cox
5,778,978 A * 7/1998 Crow ..... E21B 33/072 166/254.2
5,865,392 A * 2/1999 Blount ..... E21B 19/22 242/397.2
2007/0000670 A1 1/2007 Moore et al.
2008/0314580 A1 12/2008 Wood
(Continued)

FOREIGN PATENT DOCUMENTS

CN 208396699 U 1/2019

OTHER PUBLICATIONS

Courville, P.W., et al., "Coiled Tubing Completions: An Economic Discussion of Procedures," SPE 29781, Middle East Oil Technical Conference and Exhibition, Society of Petroleum Engineers, Mar. 11-14, 1995, 6 pages.
(Continued)

*Primary Examiner* — Giovanna Wright
(74) *Attorney, Agent, or Firm* — Thomas Rooney; Parker Justiss, P.C.

(57) ABSTRACT

Provided is a coiled tubing deployment/retrieval apparatus, a coiled tubing surface equipment spread, and a method. The coiled tubing deployment/retrieval apparatus, in one aspect, includes a frame, a coiled tubing guide coupled to the frame, and a coiled tubing injector coupled to the frame, the coiled tubing injector configured to insert or retrieve a coiled tubing string guided by the coiled tubing guide into or out of a wellbore. The coiled tubing deployment/retrieval apparatus, in one aspect, further includes a power cable injector coupled to the frame, the power cable injector configured to insert or retrieve a power cable into or out of the wellbore alongside the coiled tubing string.

27 Claims, 9 Drawing Sheets

(56) References Cited

U.S. PATENT DOCUMENTS

2009/0260695 A1* 10/2009 France ..... F16L 55/46
137/318
2016/0186507 A1 6/2016 Varkey

OTHER PUBLICATIONS

Connell, M., et al., "The Y-Block Logging System: An Alternative Method of Logging with Coiled Tubing," 4th International Conference on Coiled Tubing and Underbalanced Drilling with Emerging Technologies, Dallas, Texas, Feb. 5-7, 1996, pp. 115-120.
Bebak, K.T., et al., "Alternate Deployed Systems Application Guide," SPE 141817, Middle East Oil and Gas Show and Conference, Society of Petroleum Engineers, Sep. 25-28, 2011, 14 pages.
Roth, B. A., et al., "Novel Electric Submersible Pump Cable Operates in High H2S Production Environment," SPE-184197-MS, Society of Petroleum Engineers, Middle East Artificial Lift Conference and Exhibition, Nov. 30-Dec. 1, 2016, 17 pages.
Alkhorayef, S. S., et al., "Long Term Corrosion Risk Evaluation of Load Bearing High Power Electrical Submersible Pump Cable", OTC-34898-MS, Offshore Technology Conference Asia, Feb. 27-Mar. 1, 2024, 24 pages.

* cited by examiner

200

188

COILED TUBING DEPLOYMENT/RETRIEVAL APPARATUS, A COILED TUBING SURFACE EQUIPMENT SPREAD, AND METHOD THAT EMPLOY A POWER CABLE INJECTOR

CROSS-REFERENCE TO RELATED APPLICATION

This application claims the benefit of U.S. Provisional Application Ser. No. 63/659,767, filed on Jun. 13, 2024, entitled "CONVEYING AND ELECTRICALLY POWERING A DOWNHOLE DRILLING APPARATUS," and U.S. Provisional Application Ser. No. 63/665,709, filed on Jun. 28, 2024, entitled "CONVEYING AND ELECTRICALLY POWERING A DOWNHOLE DRILLING APPARATUS EMPLOYING REVERSE CIRCULATION," both of which are commonly assigned with this application and incorporated herein by reference in their entirety.

BACKGROUND

A coiled or spoolable tubing string is commonly used in various oil and gas operations, including the drilling of wellbores, work over operations, completion operations and production operations, among others. A coiled tubing string is a continuous string of tubing that is spooled on a coiled tubing reel as a conveying device for one or more downhole tools. A coiled tubing injector is often used to insert or retrieve a coiled tubing string into or out of a wellbore.

For drilling, a bottom hole assembly (BHA) carrying a drill bit at its bottom end (e.g., downhole end) may be attached to the coiled tubing string's bottom end (e.g., downhole end). In many embodiments, the coiled tubing string is hollow or has a through passage, which acts as a conduit for the drilling and/or process fluid to be supplied downhole under pressure from the surface. For completion and workover operations, the coiled tubing string may be used to insert or retrieve a coiled tubing string into or out of the wellbore.

BRIEF DESCRIPTION

Reference is now made to the following descriptions taken in conjunction with the accompanying drawings, in which.

Figure 3A:
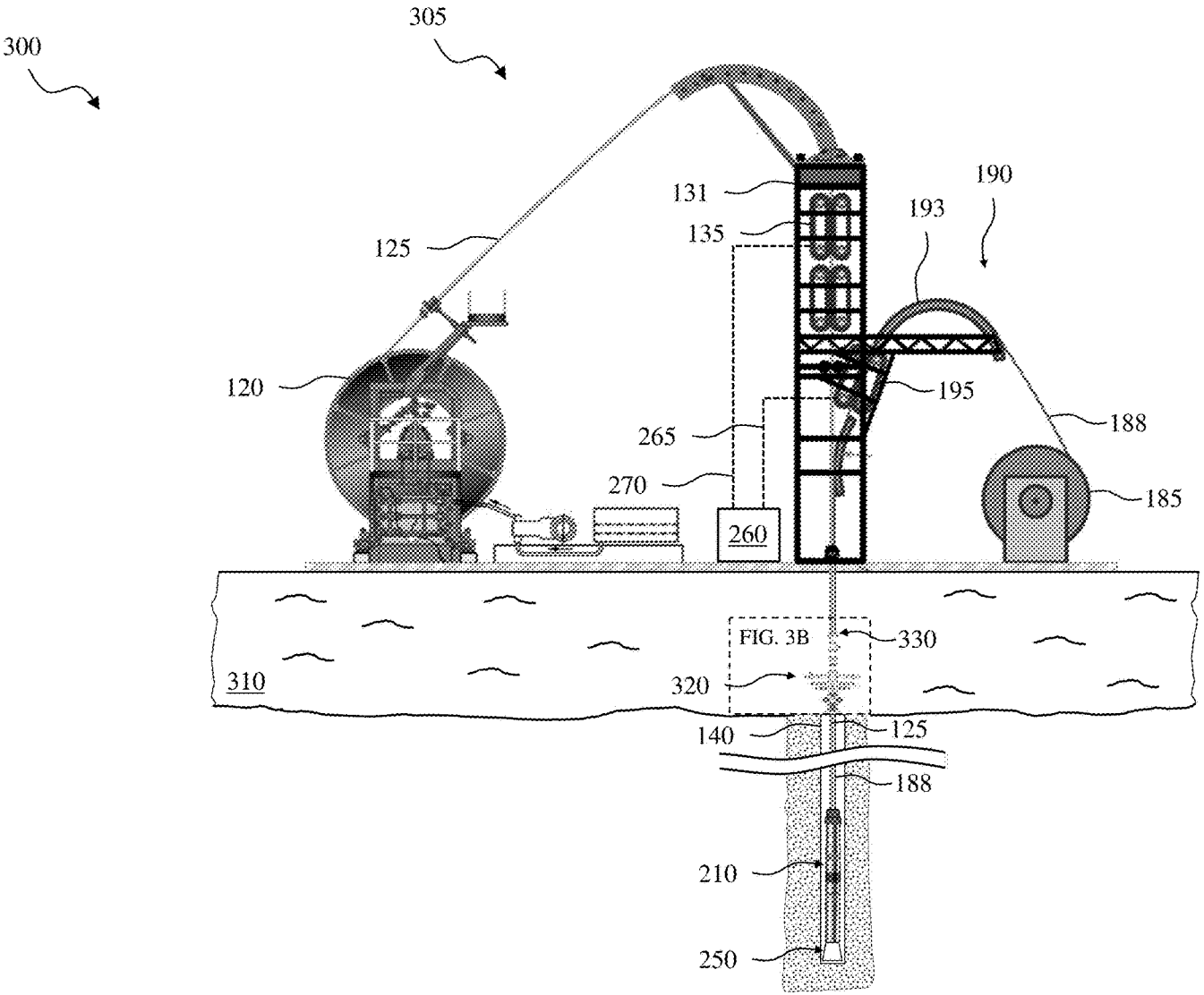
Figure 3B:
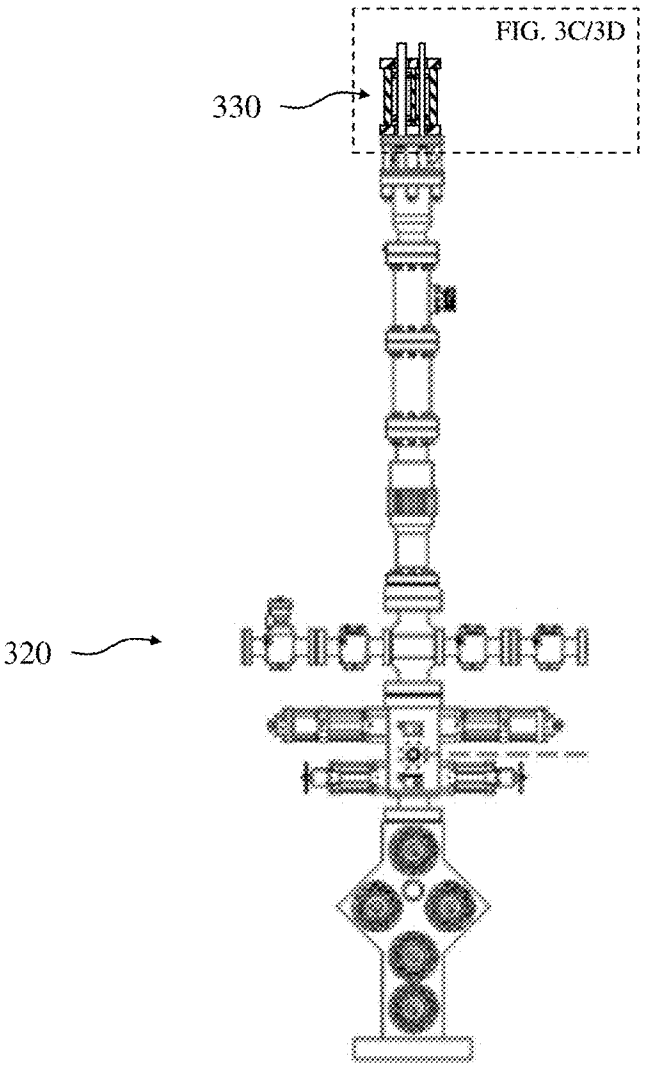
Figure 3C:
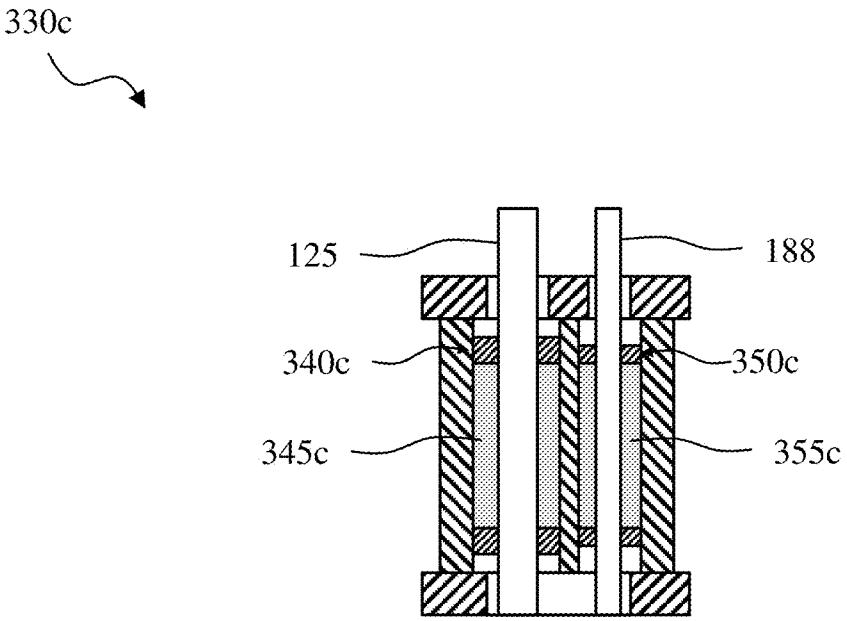
Figure 3D:
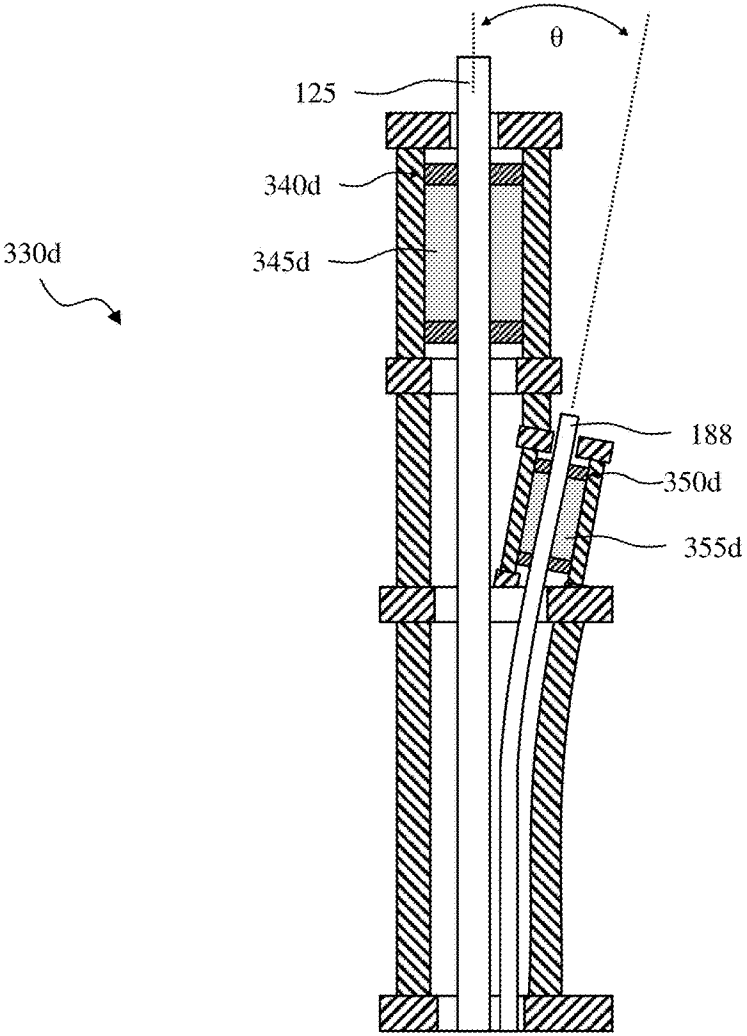
Figure 4:
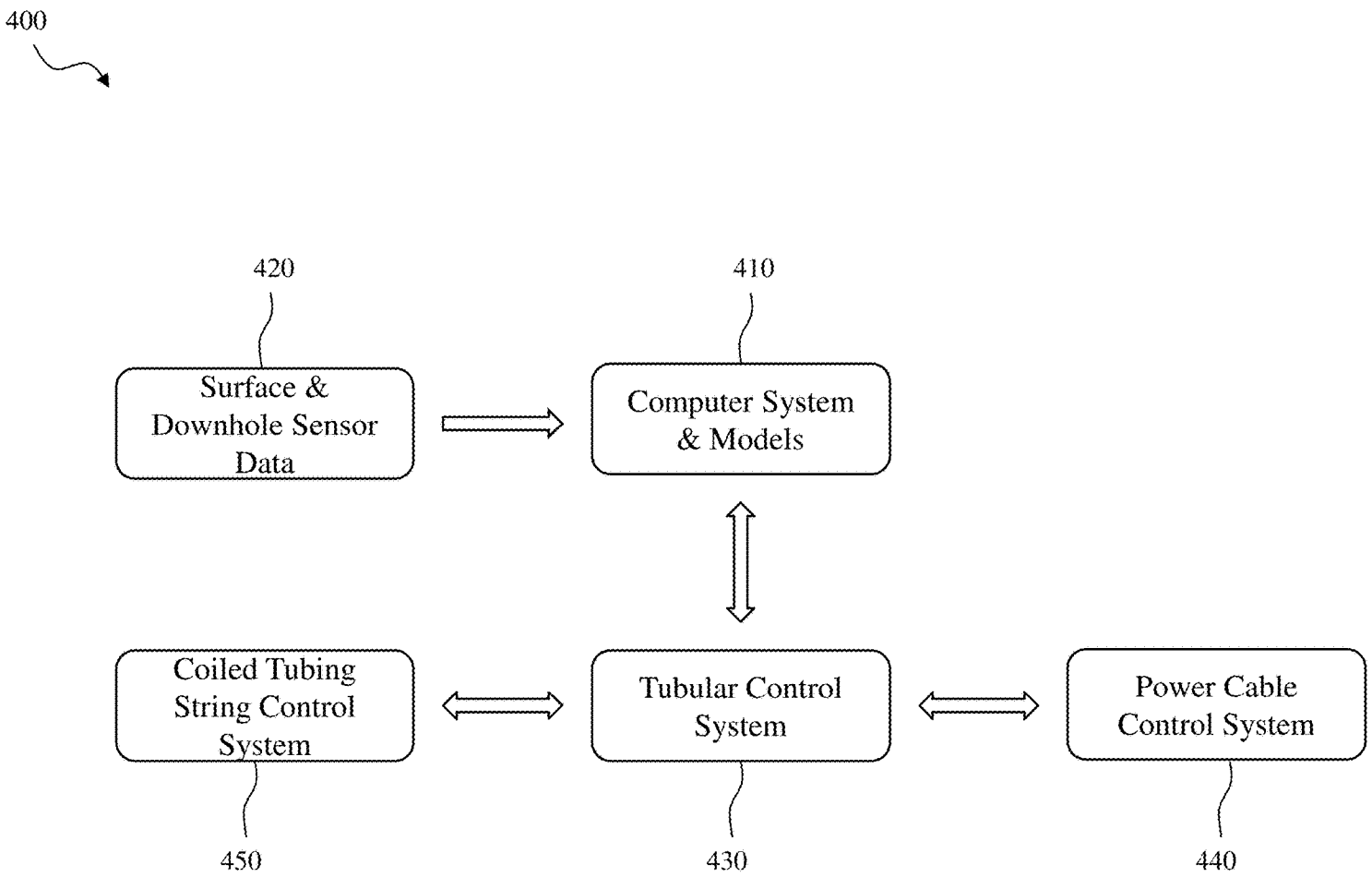

FIGS. 3A through 3D illustrate different views a well system including a coiled tubing surface equipment spread for running a coiled tubing string within a wellbore, the coiled tubing surface equipment spread designed, manufactured and operated according to an alternative embodiment of the disclosure; and FIG. 4 illustrates a representation of a system that may be employed to perform various steps, methods, and techniques disclosed herein (e.g., via the execution of software)

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the subterranean formation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

Various values and/or ranges are explicitly disclosed in certain embodiments herein. However, values/ranges from any lower limit may be combined with any upper limit to recite a range not explicitly recited. Similarly, values/ranges from any lower limit may be combined with any other lower limit to recite a range not explicitly recited. In the same way, values/ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited. Similarly, an individual value disclosed herein may be combined with another individual value or range disclosed herein to form another range.

The terms "substantially XYZ," "about XYZ," "approximately XYZ." as used herein, means that it is within 10 percent of perfectly XYZ. The term "significantly XYZ," as used herein, means that it is within 5 percent of perfectly XYZ. The term "ideally XYZ," as used herein, means that it is within 1 percent of perfectly XYZ. The monicker "XYZ" could refer to parallel, perpendicular, alignment, or other relative features disclosed herein.

Pulsed power drilling with a coiled tubing (CT) string requires supplying a high electric power (e.g., on the order of 105 kW to 500 kW and above 10 kV DC voltage) to the pulsed power drilling system located proximate the bottom hole assembly (BHA). Pulsed power drilling also requires a high fluid flow rate for drilling and cutting transport to surface (e.g., on the order of up to about 1900 Liters (e.g., 500 gallons) per minute, or more). A pulsed power drilling system that uses a large coiled tubing string outside diameter (OD) (e.g., 11.4 cm or about 4.5 inches) has been considered, which places a power cable within the inside diameter (ID) of the large coiled tubing string. Unfortunately, the combined weight of the coiled tubing string and power cable, as well as overall coiled tubing reel size, is often too large for transport and lifting as a single coiled tubing string. This is particularly the problem in long reach applications greater than about 6,105 meters (e.g., greater than about 20,000 feet).

In response thereto, it has been attempted to employ a combination of shorter coiled tubing strings having the aforementioned specifications. In one scenario, each of the shorter coiled tubing strings has the power cable positioned within its inside diameter (ID), and each are connected and disconnected at the wellsite prior to being insert within the wellbore or retrieved from the wellbore. Unfortunately, such a design requires designing special wet connectors for connecting the combination of short coiled tubing strings and power cables, plus special equipment to manage and align the coiled tubing string ends for making such connections. Furthermore, the safety risks and time needed for connecting and disconnecting the combination of short coiled tubing strings and power cables would be significant, and possibly prohibitive, for example based upon the final solution.

Thus, the present disclosure addresses, at least in part, the challenges of using the coiled tubing and power cables (e.g., high power cables) needed for pulsed power drilling with coiled tubing. The present disclosure, in one or more embodiments, eliminates the need for having multiple shorter coiled tubing strings and power cables, and thus the associated connections and handling. The present disclosure, in contrast, enables running a larger power cable alongside (e.g., outside) of the coiled tubing string (e.g., a single smaller outside diameter (OD) coiled tubing string, for example approximately 9 cm (e.g., about 3.5 inch) outside diameter (OD) as compared to the separately considered 11.4 cm (e.g., about 4.5 inch) outside diameter (OD) when the power cable is placed therein), in at least one embodiment without clamping the larger power cable to the coiled tubing string along the coiled tubing string length.

This may be achieved while providing enough electric power through the power cable and enough fluid flow rate through the coiled tubing string for pulsed power drilling operations, among others. The present disclosure, in at least one embodiment, eliminates the need for having to use multiple connected shorter coiled tubing strings with power cables inside them, which in turn would require larger outside diameters (ODs) and inside diameters (IDs) (e.g., which would increase the weight of the coiled tubing string to values that would place transport and lifting constraints thereon). The present disclosure also reduces (e.g., eliminates) certain related challenges associated with the multiple shorter coiled tubing strings with power cables inside them, such as cable insertion, connecting and disconnecting the multiple shorter coiled tubing strings and power cables during jobs (e.g., and the increased time and cost associated therewith), special coiled tubing and wet connect cable connectors, special handling of the coiled tubing strings to connect and disconnect the coiled tubing string and power cable connections, and related safety risks, among many others.

In at least one embodiment, the proposed solution includes running a power cable (e.g., steel or alloy encapsulated power cable, which in one embodiment may also include independent communications conductors and/or flowline tubes) outside/alongside a coiled tubing string (e.g., a single coiled tubing string). In at least one embodiment, this is accomplished without any clamping/attaching of the power cable to the coiled tubing string. In yet another embodiment, any associated clamps (e.g., clamps that clamp/attach the power cable to the coiled tubing string) are located at least 50 m apart (e.g., no two clamps fixing the coiled tubing string and power cable together are positioned within 50 m from one another), if not at least 100 m apart (e.g., no two clamps fixing the coiled tubing string and power cable together are positioned within 100 m from one another), if not at least 250 m apart (e.g., no two clamps fixing the coiled tubing string and power cable together are positioned within 250 m from one another), if not at least 500 m apart (e.g., no two clamps fixing the coiled tubing string and power cable together are positioned within 500 m from one another), if not at least 1,000 m apart (e.g., no two clamps fixing the coiled tubing string and power cable together are positioned within 1,000 m from one another), if not at least 2,500 m apart (e.g., no two clamps fixing the coiled tubing string and power cable together are positioned within 2,500 m from one another), if not at least 5,000 m apart (e.g., no two clamps fixing the coiled tubing string and power cable together are positioned within 5,000 m from one another), if not at least 10,000 m part (e.g., no two clamps fixing the coiled tubing string and power cable together are positioned within 10,000 m from one another), if not at least 15,000 m apart (e.g., no two clamps fixing the coiled tubing string and power cable together are positioned within 15,000 m from one another), if not at least 20,000 m apart (e.g., no two clamps fixing the coiled tubing string and power cable together are positioned within 20,000 m from one another), among others.

In at least one embodiment, this may be accomplished using a separate and/or independent power cable injector that is operated in coordination with the coiled tubing string (e.g., in coordination with the coiled tubing injector of the coiled tubing string). In at least one embodiment, the power cable is connected (e.g., only connected) to the bottom hole assembly (BHA) and is not attached (e.g., connected/clamped) anywhere along a length of the coiled tubing string. In at least one embodiment, the system might employ a tubular control system, which may use surface and/or downhole sensor data and/or computer models to run the coiled tubing string and the power cable in coordination during jobs. It is believed that the synchronization, as detailed herein, may be needed to avoid the coiled tubing string (e.g., which is much stronger) from axially stretching and/or compressing the power cable during downhole/uphole movement thereof.

The coiled tubing string, in one or more embodiments, may be made of any currently available or newly designed coiled tubing material. Similarly, the power cable may be made like a standard power cable, but may also include communications conductors and/or one or more fluid flowline tubes. In at least one embodiment, the fluid flow line tubes are employed to cool the power cable, which may be helpful in high power applications that generate a great deal of heat. In at least one embodiment, the fluid flow line tubes have an outlet to discharge the cooling fluid at the bottom of the bottom hole assembly (BHA). In yet another embodiment, the fluid flow line tubes form a loop down to the bottom hole assembly (BHA) and back up to the surface of the wellbore, for example if the cooling fluid comprises an environmentally unfriendly material that should not be discharged in the wellbore. In at least one embodiment, the power cable is encapsulated in a rigid (e.g., steel or alloy) jacket and/or tube so that it can support its own weight in the wellbore and function as a protective barrier to minimize cable damage.

In one embodiment, for example for pulsed power drilling operations, the coiled tubing string would have approximately a 9 cm outside diameter (OD), a wall thickness along the coiled tubing string ranging from about 7.62 mm to about 3.18 mm (e.g., tapered from the uphole end of the coiled tubing string to the downhole end of the coiled tubing string), or alternatively ranging from about 5.68 mm to about 3.96 mm, and a length of up to about 7,300 meters, and be comprised of at least 130 ksi yield strength grade material. Such an embodiment would allow fluid flow rates through the coiled tubing string of up to about 1900 Liters (e.g., 500 gallons) per minute, which can be enough for pulsed power drilling operations, and effective hole cleaning and solid transport to the surface. Moreover, the overall power cable outside diameter (OD) and composition could be tailored, for example depending on the needs of the job. Nevertheless, in one example embodiment the power cable outside diameter (OD) ranges from about 3.8 cm (e.g., about 1.5 inches) to about 4.45 cm (e.g., about 1.75 inches), and could include multiple wires for electric power and communication.

In at least one other embodiment, the coiled tubing string (e.g., as there are no power cables placed therein in certain embodiments) could be used for reverse circulation when the bottom hole assembly (BHA) (e.g., electric pulsed power drilling bottom hole assembly (BHA)) is drilling the wellbore. In this embodiment, the drilling fluid would traverse down an annulus of the wellbore between the wellbore itself and the coiled tubing string, and then the cuttings and drilling fluid would enter the bottom hole assembly (BHA) and traverse back uphole to the surface of the wellbore through the coiled tubing string. In this embodiment, the original drilling fluid would pass around the power cable(s) as it traverses downhole from the surface of the wellbore to the bottom hole assembly (BHA). In one or more embodiments, well pressure control equipment, such as a blowout preventer (BOP), could be used at the surface of the wellbore.

In at least one embodiment of this reverse circulation scenario, the coiled tubing string could have an anti-erosion layer disposed along an inside surface of the coiled tubing string. This anti-erosion layer, when used, would significantly reduce any erosion that might arise as the cutting and drilling fluid traverse back uphole to the surface of the wellbore. In at least one embodiment, the anti-erosion layer has a hardness at least 5% greater than a hardness of the coiled tubing string (e.g., as might be measured using the Rockwell, Vickers or Brinell hardness testing methods). In at least one other embodiment, the anti-erosion layer has a hardness at least 10% greater than a hardness of the coiled tubing string, if not 25% greater, if not 50% greater, if not 100% greater, if not 200% greater.

The anti-erosion layer may comprise many different materials and remain within the purview of the disclosure. In at least one embodiment, however, the anti-erosion layer is a thin layer of metal or polymer. For example, the anti-erosion layer might have a thickness of less than 15 mm, if not less than 0.1 mm, if not less than 0.05 mm, such that the addition of the anti-erosion layer does not significantly increase the weight of the coiled tubing string.

In yet other embodiments, no anti-erosion layer is employed on the inside of the coiled tubing string, however, a more viscous drilling fluid is used that would allow the velocity of the reverse circulation to be reduced. The lower velocity of the cuttings and drilling fluid traversing through the coiled tubing string, would independently reduce the erosion effect that may occur during this reverse circulation. In yet another embodiment, a combination of the more viscous drilling fluid, lower velocity of the cutting and drilling fluid and anti-erosion layer may be used.

The above paragraphs have discussed many of the details of the present disclosure in connection with a pulsed power drilling operation scenario. Notwithstanding, such details, as well as the details discussed below, could potentially be used with other high power downhole applications, including other high power downhole applications that require high power to the bottom hole assembly (BHA). Similarly, many aspects of the present disclosure may be used when conveying two or more wellbore features (e.g., wellbore tubulars, coiled tubing strings, jointed pipe, power cables, communication cables, etc.) in parallel (e.g., wherein a first wellbore feature (coiled tubing string) is used with a first injector, and a second wellbore feature (coiled tubing string) is used with a second injector, and for example a third wellbore feature is used with a third injector, all of which may be insert within a same wellbore simultaneously and optionally all connected to the same frame), as well as be used with jointed/drill pipe applications that do not employ coiled tubing.

Figure 1:
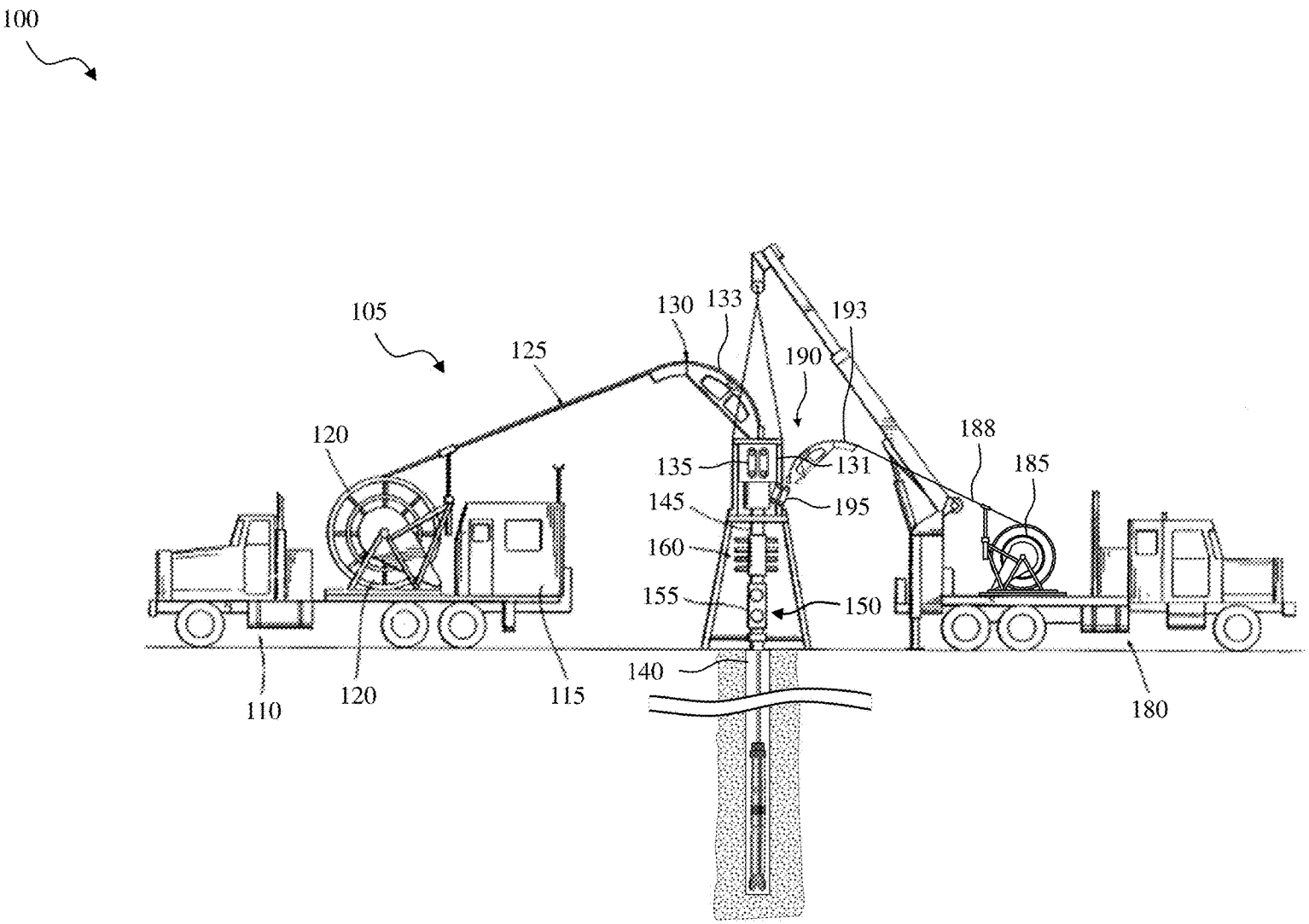
FIG. 1 illustrates a well system including a coiled tubing surface equipment spread for running a coiled tubing string within a wellbore, the coiled tubing surface equipment spread designed, manufactured and operated according to one embodiment of the disclosure.

FIG. 1 illustrates a well system 100 including a coiled tubing surface equipment spread 105 for running a coiled tubing string 125 (e.g., first or second wellbore feature) within a wellbore 140, the coiled tubing surface equipment spread 105 designed, manufactured and operated according to one embodiment of the disclosure. In at least one embodiment, the coiled tubing surface equipment spread 105 includes a truck 110, a wellhead stack 150, and a crane truck 180. In the illustrated embodiment, the truck 110 (e.g., coiled tubing truck) carries behind its cab a power pack including a hook-up to the truck motor or power take off, hydraulic pumps and an air compressor. The coiled tubing injecting operation can be run from the control cab 115 located at the rear of truck 110. Control cab 115, in one or more embodiments, forms the operational center. A coiled tubing reel 120 may be positioned at one or more different locations, but in the embodiment of FIG. 1 the coiled tubing reel 120 is positioned on the truck 110. The coiled tubing reel 120 comprises the spool that carries the coiled tubing string 125 to/at the job site. The coiled tubing reel 120 is often limited in its outside spool diameter so that, with a full load of coiled tubing string 125 wound thereon, the coiled tubing reel 120 can be trucked over the highways or waterway and to a job site.

FIG. 1 additionally illustrates the coiled tubing string 125 passing over a coiled tubing deployment/retrieval apparatus 130, and inserted into the wellbore 140 (e.g., open hole wellbore, partially cased wellbore and/or fully cased wellbore). In the illustrated embodiment, the coiled tubing deployment/retrieval apparatus 130 includes a frame 131, as well as a coiled tubing guide 133 (e.g., upper gooseneck in one embodiment) coupled to the frame 131, and a coiled tubing injector 135 (e.g., first injector or second injector) coupled to the frame 131. In the illustrated embodiment, the coiled tubing reel 120 is positioned proximate the coiled tubing deployment/retrieval apparatus 130. The term "proximate," as used herein with respect to the coiled tubing reel 120, means that it is located within 250 meters of the coiled tubing deployment/retrieval apparatus 130. In yet another embodiment, however, the coiled tubing reel 120 is positioned within 100 meters of the coiled tubing deployment/retrieval apparatus 130, if not within 50 meters, if not within 25 meters, if not within 10 meters, if not within 5 meters, or less, of the coiled tubing deployment/retrieval apparatus 130. Nevertheless, as discussed above, in the embodiment of FIG. 1 the coiled tubing reel 120 is positioned on the truck 110.

In at least one embodiment, the coiled tubing injector 135 involves two hydraulic motors and two counter-rotating chains by means of which the coiled tubing injector 135 grips the coiled tubing string 125 and spools or unspools the coiled tubing string 125 to and/or from the coiled tubing reel 120. In at least one embodiment, a coiled tubing stripper 145 provides a pressure barrier between coiled tubing string 125 and the wellbore 140. The wellhead stack 150 is illustrated as having a typical well Christmas tree 155 and blowout preventer (BOP) 160.

FIG. 1 additionally illustrates that a power cable reel 185 may be positioned at one or more different locations along the coiled tubing surface equipment spread 105. In the illustrated embodiment, the power cable reel 185 is positioned proximate the coiled tubing deployment/retrieval apparatus 130. The term "proximate," as used herein with respect to the power cable reel 185, means that it is located within 250 meters of the coiled tubing deployment/retrieval apparatus 130. In yet another embodiment, however, the power cable reel 185 is positioned within 100 meters of the coiled tubing deployment/retrieval apparatus 130, if not within 50 meters, if not within 25 meters, if not within 10 meters, if not within 5 meters, or less, of the coiled tubing deployment/retrieval apparatus 130. Nevertheless, in the embodiment of FIG. 1, the power cable reel 185 is positioned on the crane truck 180. The power cable reel 185, in at least one embodiment, comprises the spool that carries a power cable 188 (e.g., second wellbore feature or first wellbore feature) to/from the job site.

FIG. 1 additionally illustrates the power cable 188 passing over a power cable deployment/retrieval apparatus 190, and insert into the wellbore 140 (e.g., open hole wellbore, partially cased wellbore and/or fully cased wellbore). In the illustrated embodiment, the power cable deployment/retrieval apparatus 190 includes a power cable guide 193 coupled to the frame 131, and a power cable injector 195 (e.g., separate power cable injector, second injector or first injector, etc.). In at least this one embodiment, the power cable injector 195 is configured to insert or retrieve the power cable 188 guided by the power cable guide 193 into or out of the wellbore 140 alongside the coiled tubing string 125. While the coiled tubing injector 135 and the power cable injector 195 may be operated at the same time, they may be designed such that they can operate at different speeds and remain within the scope of the disclosure.

Figure 2A:
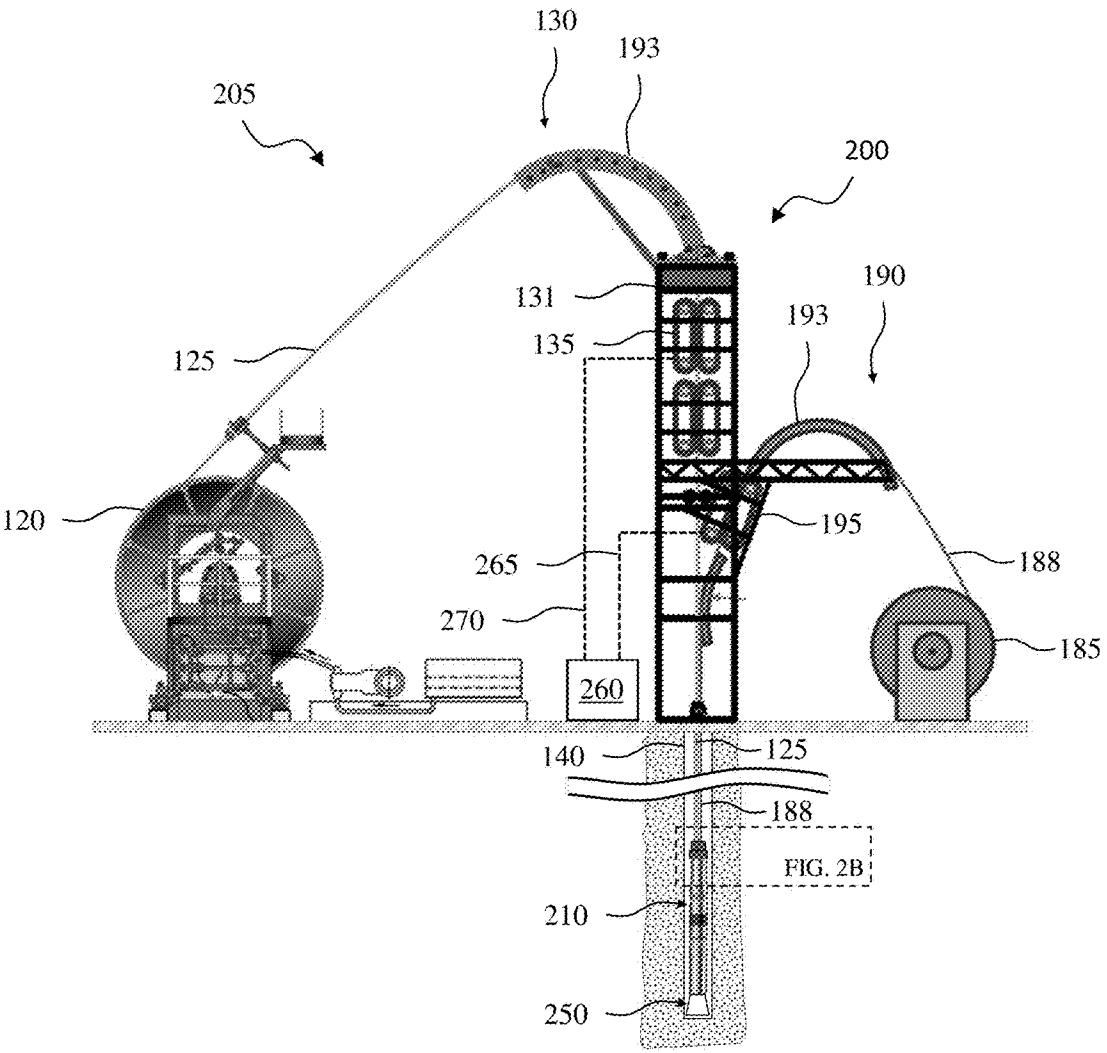
FIGS. 2A through 2C illustrate different views of a well system including a coiled tubing surface equipment spread for running a coiled tubing string within a wellbore, the coiled tubing surface equipment spread designed, manufactured and operated according to an alternative embodiment of the disclosure.

Turning to FIG. 2A, illustrated is a well system 200 including a coiled tubing surface equipment spread 205 designed, manufactured and operated according to an alternative embodiment of the disclosure. The well system 200 and coiled tubing surface equipment spread 205 of FIG. 2A are similar in many respects to the well system 100 and coiled tubing surface equipment spread 105 of FIG. 1. Accordingly, like reference numbers have been used to indicate similar, if not identical, features. The well system 200, and associated coiled tubing surface equipment spread 205, in at least one embodiment, may find its primary use with a bottom hole assembly (BHA) 210 employing a pulsed power drilling system 250. In at least this one embodiment, the pulsed power drilling system 250 replaces traditional drilling tools (e.g., electrodes replacing the drill bit of FIG. 1) by generating electric pulsating arc through rock and breaking the rock. As shown in this embodiment, the power cable is run alongside (outside) coiled tubing string. Furthermore, in at least one embodiment, the power cable is not attached to coiled tubing string (e.g., connected only to the bottom hole assembly (BHA) and not along the length of the coiled tubing string).

In the embodiment of FIG. 2A, the coiled tubing string 125 is used to convey the pulsed power drilling system 250 and pumped fluid downhole within the wellbore 140. Similarly, the power cable 188 is used to convey electric power to the pulsed power drilling system 250, and in certain embodiments can include conductors for communications (and possibly hydraulic flow lines).

The coiled tubing surface equipment spread 205 of FIG. 2A is often used when drilling a wellbore with coiled tubing and an electrically powered drilling apparatus (e.g., such as the pulsed power drilling system 250). In at least one embodiment, the coiled tubing surface equipment spread 205 may be used with wellbores having at least a 6,100 meter well depth, and 20 cm or larger wellbore size. In at least one embodiment, from about 100 KW to about 500 kW electric power is employed by the pulsed power drilling system 250. Often, the coiled tubing string 125 and power cable 188 sizes will depend on the well depths, fluid flow rates, and/or electric power needs, among other requirements. Notwithstanding, in at least one embodiment, the coiled tubing string 125 outside diameter (OD) ranges from about 6.35 cm to about 10.25 cm, if not from about 7.62 cm to about 9.53 cm, if not about 8.89 cm. Similarly, in at least one embodiment, the power cable 188 outside diameter (OD) ranges from about 1.91 cm to about 5.72 cm, if not from about 2.54 cm to about 5.08 cm, if not about 3.81 cm. All the above values may be useable in wellbore lengths greater than about 4,500 m, if not greater than about 6,100 m, if not greater than about 7,600 m, if not greater than about 9,200 m.

In at least one embodiment, the coiled tubing surface equipment spread 205 of FIG. 2A includes a tubular control system 260. The tubular control system 260 may be autonomous, in that it does not include human intervention, but in other embodiments may be semi-autonomous, or human controlled. In at least one embodiment, the tubular control system 260 is configured to operate the coiled tubing injector 135 and the power cable injector 195 in coordination, for example to insert the coiled tubing string 125 and the power cable 188 within the wellbore 140 or to retrieve the coiled tubing string 125 and the power cable 188 from the wellbore 140. In at least one embodiment, the tubular control system 260 includes a power cable control system 265 that is coupled with the power cable injector 195. In this embodiment, the power cable control system 265 is configured to modulate a power cable rate upon which the power cable injector 195 inserts the power cable 188 within the wellbore 140 or retrieves the power cable 188 from the wellbore 140 (e.g., relative to a coiled tubing rate upon which the coiled tubing injector 135 inserts the coiled tubing string 125 within the wellbore 140 or retrieves the coiled tubing string 125 from the wellbore 140). In yet another embodiment, the tubular control system 260 includes a coiled tubing string control system 270, the coiled tubing string control system 270 configured modulate the coiled tubing rate upon which the coiled tubing injector 135 inserts the coiled tubing string 125 within the wellbore 140 or retrieves the coiled tubing string 125 from the wellbore 140 (e.g., relative to a power cable rate upon which the power cable injector 195 inserts the power cable 188 within the wellbore 140 or retrieves the power cable 188 from the wellbore 140).

Figure 2B:
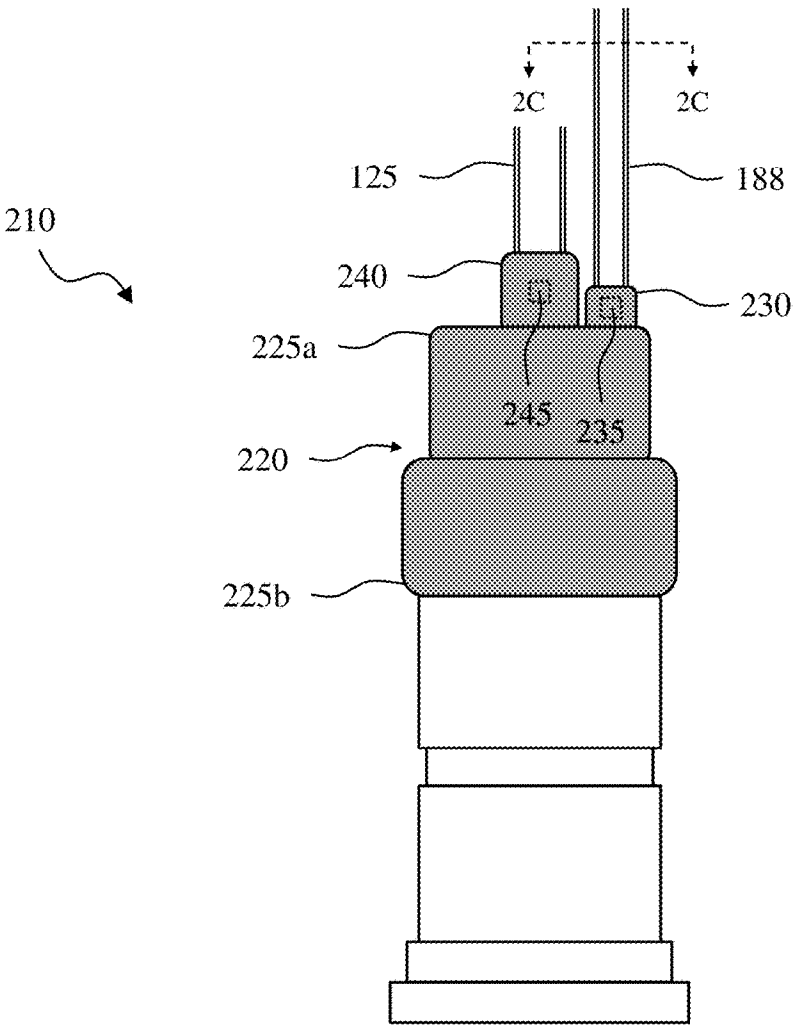

Turning now to FIG. 2B, with continued reference to FIG. 2A, illustrated is a zoomed in view of the bottom hole assembly (BHA) 210 of FIG. 2A. In the illustrated embodiment, the bottom hole assembly (BHA) 210 is coupled to both of the coiled tubing string 125 and the power cable 188. Further to this embodiment, the bottom hole assembly (BHA) 210 may include a bottom hole assembly (BHA) housing 220, the bottom hole assembly (BHA) housing 220 including an uphole end 225*a* and a downhole end 225*b*. Further to the embodiment of FIG. 2B, the uphole end 225*a* may include a power cable connector 230 engaging with the power cable 188 and a coiled tubing connector 240 engaging with the coiled tubing string 125 and.

In at least one embodiment, the tubular control system 260 (e.g., power cable control system 265) includes a tension measuring device associated with the power cable 188, the tension measuring device configured to measure an amount of tension or compression (e.g., axial tension or axial compression) on the power cable 188 as the power cable injector 195 inserts the power cable 188 within the wellbore 140 or retrieves the power cable 188 from the wellbore 140. In this embodiment, the tubular control system 260 (e.g., power cable control system 265) is configured to modulate the power cable rate upon which the power cable injector 195 inserts the power cable 188 within the wellbore 140 or retrieves the power cable 188 from the wellbore 140 based upon data obtained from the tension measuring device. In at least one embodiment, the tension measuring device is associated with the bottom hole assembly (BHA) housing 220, the tension measuring device configured to couple between the bottom hole assembly (BHA) housing 220 and the power cable 188 to measure the amount of tension or compression on the power cable 188 (e.g., proximate the bottom hole assembly (BHA) housing 220)

In the illustrated embodiment of FIG. 2B, a first tension measuring device 235 is associated with the power cable 188. For example, the first tension measuring device 235 could be coupled between the bottom hole assembly (BHA) housing 220 and the power cable 188 (e.g., in the power cable connector 230). Accordingly, the first tension measuring device 235, which could comprise a load cell, could be used to measure the amount of tension or compression on the power cable 188 (e.g., proximate the bottom hole assembly (BHA) housing 220).

Further to the embodiment of FIG. 2B, a second tension measuring device 245 is associated with the coiled tubing string 125. For example, the second tension measuring device 245 could be coupled between the bottom hole assembly (BHA) housing 220 and the coiled tubing string 125 (e.g., in the coiled tubing connector 240). Accordingly, the second tension measuring device 245, which could also comprise a load cell, could be used to measure the amount of tension or compression on the coiled tubing string 125 (e.g., proximate the bottom hole assembly (BHA) housing 220). While the embodiment of FIG. 2B illustrates particular placements for the first and second tension measuring devices 235, 245, other embodiments could place them in different locations in the well system 200, for example so long as they are placed to measure the tension and/or compression on the power cable 188 and/or coiled tubing string 125, respectively.

Given the foregoing embodiments, data from the first tension measuring device 235 may be fed to the tubular control system 260 (e.g., power cable control system 265). In turn, the tubular control system 260 (e.g., power cable control system 265) may modulate a power cable rate upon which the power cable injector 195 inserts the power cable 188 within the wellbore 140 or retrieves the power cable 188 from the wellbore 140 (e.g., relative to a coiled tubing rate upon which the coiled tubing injector 135 inserts the coiled tubing string 125 within the wellbore 140 or retrieves the coiled tubing string 125 from the wellbore 140). Similarly, data from the second tension measuring device 245 may be fed to the tubular control system 260 (e.g., coiled tubing string control system 270). In turn, the tubular control system 260 (e.g., coiled tubing control system) may modulate a coiled tubing rate upon which the coiled tubing injector 135 inserts the coiled tubing string 125 within the wellbore 140 or retrieves the coiled tubing string 125 from the wellbore 140 (e.g., relative to a power cable rate upon which the power cable injector 195 inserts the power cable 188 within the wellbore 140 or retrieves the power cable 188 from the wellbore 140). In certain embodiments, only the power cable control system 265 is used, and the coiled tubing string control system 270 is not, and in certain other embodiments the opposite is true. Nevertheless, in the illustrated embodiment, both the power cable control system 265 and the coiled tubing string control system 270 are being employed. Furthermore, while the power cable control system 265 and the coiled tubing string control system 270 are illustrated as part of the integrated tubular control system 260, in other embodiments they are standalone systems.

Figure 2C:
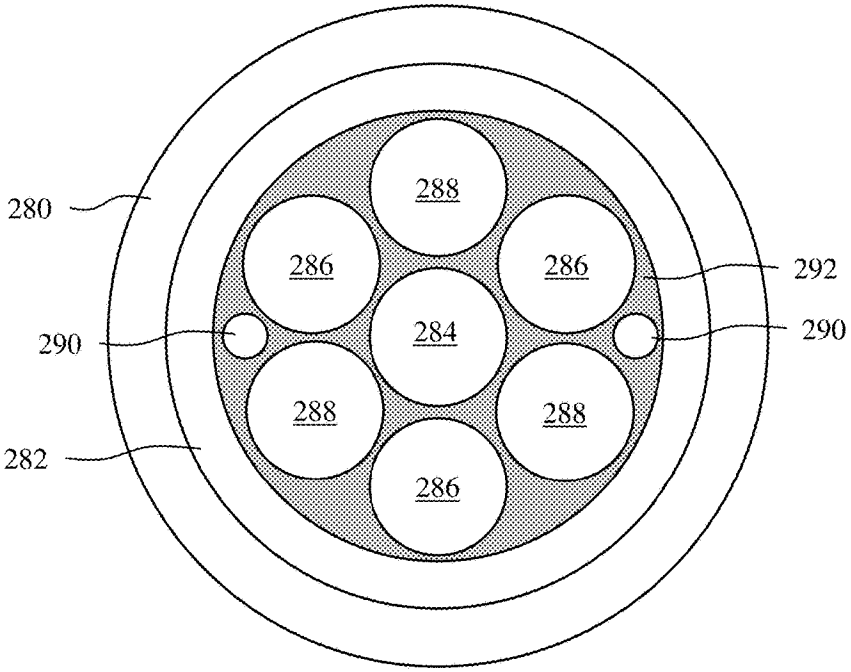

Turning to FIG. 2C, with continued reference to FIG. 2A, illustrated is a cross-sectional view of one embodiment of the power cable 188 of FIG. 2A. In the illustrated embodiment, the power cable 188 includes an outer tube 280, such as an outer metal tube. Further to the illustrated embodiment, the power cable 188 includes cable lining 282 (e.g., for electric or thermal insulation, coupling and load transfer between the outer tube 280 and the inner insulation material 292, for additional support of external pressure or forces/weight exerted on the power cable, or for other purposes). Further to the illustrated embodiment, the power cable 188 may include a primary fluid hydraulic flowline 284 (e.g., for providing operation fluid to/from the bottom hole assembly (BHA) 210), which may also include its own anti-erosion layer. Further to the illustrated embodiment of FIG. 2C, the power cable 188 may include one or more hydraulic control flowlines 286 (e.g., for providing control fluid to/from the bottom hole assembly (BHA) 210), one or more power conductors 288 (e.g., one or more power conductors for powering the pulsed power drilling system 250), and one or more communication conductors 290 (e.g., one or more electric and/or fiberoptic communication conductors). In at least one embodiment, an insulation material 292 may be located within the outer tube 280, thereby surrounding at least a portion of one or more of the primary fluid hydraulic flowline 284, hydraulic control flowlines 286, power conductors 288 and/or communication conductors 290.

The coiled tubing surface equipment spread 205 of FIGS. 2A through 2C has many advantages over traditional designs, including those traditional designs that place the power cable within the inside diameter (ID) of the coiled tubing string 125. In at least one embodiment, the coiled tubing surface equipment spread 205 of FIGS. 2A through 2C enables having a single, full-length coiled tubing string 125, and a single, full-length power cable 188 (e.g., power & communication cable). Thus, in one embodiment, this provides for a smaller coiled tubing string 125 outside diameter (OD) and a less heavy coiled tubing string 125. This also, in one or more embodiments, reduces coiled tubing string 125 transport and lifting challenges (e.g., including weight and size). This may further eliminate certain challenge of inserting the large power cable 188 inside the coiled tubing string 125, as well as eliminate the need for connecting and disconnecting multiple coiled tubing strings 125 and power cables 188. The coiled tubing surface equipment spread 205 according to FIGS. 2A through 2C of the present disclosure further provides unobstructed fluid flow through the coiled tubing string 125, as well as safer and lower cost operation.

Additionally, the coiled tubing surface equipment spread 205 of FIGS. 2A through 2C has many advantages over having the power cable 188 frequently clamped to coiled tubing string 125 outside diameter (OD). For example, in at least one embodiment, this provides for much faster running in and pulling out of the coiled tubing string 125 from the wellbore 140. In yet another embodiment, this provides for safer operation, for example as there is no need to install cable clamps while running in and removing them while pulling the coiled tubing string 125 out of the wellbore 140. In even yet another embodiment, this provides simpler well pressure control at the surface (e.g., can use combined or individual/separate strippers for coiled tubing string and cable, no clamps to pass through surface/well control equipment, etc.).

Turning to FIG. 3A, illustrated is a well system 300 including a coiled tubing surface equipment spread 305 designed, manufactured and operated according to an alternative embodiment of the disclosure. The well system 300 and coiled tubing surface equipment spread 305 of FIG. 3 are similar in many respects to the well system 200 and coiled tubing surface equipment spread 205 of FIG. 2A. Accordingly, like reference numbers have been used to indicate similar, if not identical, features. The well system 300, and associated coiled tubing surface equipment spread 305, in the illustrated embodiment, is positioned over water 310, for example in an offshore application employing a riser type design or a riser-less type design. In at least one embodiment, the well system 300 further includes well pressure control equipment 320, in this instance a blowout preventor (BOP). Further to the embodiment of FIG. 3A, the well system 300 may include a stripper system 330, the stripper system 330 configured to provide a pressure barrier between one or more of the coiled tubing string 125 and/or the power cable 188 and the wellbore 140.

Turning briefly to FIG. 3B, illustrated is a zoomed in view of the well pressure control equipment 320 and stripper system 330 of FIG. 3A.

Turning now to FIG. 3C, illustrated is a zoomed in view of one embodiment of a stripper system 330*c*, which may be somewhat similar to the stripper system 330 of FIGS. 3A the 3B, designed, manufactured and/or operated according to one or more embodiments of the disclosure. In the illustrated embodiment of FIG. 3C, the stripper system 330*c* includes a coiled tubing stripper 340*c* associated with the coiled tubing injector 135, and/or a power cable stripper 350*c* associated with the power cable injector 195. In one or more embodiments, such as shown, the coiled tubing stripper 340*c* and the power cable stripper 350*c* form at least a portion of an integrated stripper associated with both the coiled tubing string 125 and the power cable 188. For example, in at least one embodiment, a coiled tubing seal 345*c* of the coiled tubing stripper 340*c* and a power cable seal 355*c* of the power cable stripper 350*c* are parallel with one another. Other embodiments of the disclosure may be used wherein the coiled tubing stripper 340*c* and the power cable stripper 350*c* form at least a portion of a non-integrated stripper.

Turning now to FIG. 3D, illustrated is a zoomed in view of one embodiment of a stripper system 330*d*, which may be somewhat similar to the stripper system 330 of FIG. 3A the 3B, designed, manufactured and/or operated according to one or more embodiments of the disclosure. In the illustrated embodiment of FIG. 3D, the stripper system 330*d* includes a coiled tubing stripper 340*d* associated with the coiled tubing injector 135, and/or a power cable stripper 350*d* associated with the power cable injector 195. In one or more embodiments, such as that shown, the coiled tubing stripper 340*d* and the power cable stripper 350*d* form at least a portion of an integrated stripper associated with both the coiled tubing string 125 and the power cable 188. For example, in at least one embodiment, a coiled tubing seal 345*d* of the coiled tubing stripper 340*d* and a power cable seal 355*d* of the power cable stripper 350*d* are angled relative to one another, for example by an angle (θ). In at least one embodiment, the angle (θ) is at least 2 degrees, if not at least 4 degrees, if not at least 10 degrees, if not at least 15 degrees, if not at least 25 degrees, if not at least 45 degrees. In at least one embodiment, the angle (θ) ranges from 5 degrees to 35 degrees, if not from 10 degrees to 25 degrees. Other embodiments of the disclosure may be used wherein the coiled tubing stripper 340*d* and the power cable stripper 350*d* form at least a portion of a non-integrated stripper.

Turning to FIG. 4, illustrated is a representation of a system 400 that may be employed to perform various steps, methods, and techniques disclosed herein (e.g., via the execution of software). In the embodiment of FIG. 4, the system 400 may include a Computer System and Models module 410 according to one or more embodiments of the disclosure. In at least one embodiment, the Computer System and Models module 410 may include one or more processor(s), cache, memory, storage, and/or one or more peripheral device(s). Any two or more of these components may be operatively connected via a system bus that provides a means for transferring data between those components.

In the illustrated embodiment, the Computer System and Models module 410 is configured to receive data from a Surface & Downhole Sensor Data Module 420. In at least one embodiment, the Surface & Downhole Sensor Data Module 420 may include one or more of a power cable tension measuring device and/or a coiled tubing string tension measuring device. In at least one embodiment, the Surface & Downhole Sensor Data Module 420 may further include one or more processor(s), cache, memory, storage, and/or one or more peripheral device(s). Any two or more of these components may be operatively connected via a system bus that provides a means for transferring data between those components.

The Computer System and Models module 410, for example having received data from the Surface & Downhole Sensor Data Module 420, is then configured to send instructions to the Tubular Control System 430 (e.g., which may operatively include the Power Cable Control System Module 440 and/or Coiled Tubing String Control System Module 450). As detailed above, the Power Cable Control System Module 440 and/or Coiled Tubing String Control System Module 450 may then: 1) modulate a power cable rate upon which the power cable injector inserts the power cable within the wellbore or retrieves the power cable from the wellbore relative to a coiled tubing rate upon which the coiled tubing injector inserts the coiled tubing string within the wellbore or retrieves the coiled tubing string from the wellbore; or 2) modulate the coiled tubing rate upon which the coiled tubing injector inserts the coiled tubing string within the wellbore or retrieves the coiled tubing string from the wellbore relative to the power cable rate upon which the power cable injector inserts the power cable within the wellbore or retrieves the power cable from the wellbore.

Aspects disclosed herein include:

A. A coiled tubing deployment/retrieval apparatus, the coiled tubing deployment/retrieval apparatus including: 1) a frame; 2) a coiled tubing guide coupled to the frame; 3) a coiled tubing injector coupled to the frame, the coiled tubing injector configured to insert or retrieve a coiled tubing string guided by the coiled tubing guide into or out of a wellbore; and 4) a power cable injector coupled to the frame, the power cable injector configured to insert or retrieve a power cable into or out of the wellbore alongside the coiled tubing string.

B. A coiled tubing surface equipment spread, the coiled tubing surface equipment spread including: 1) a coiled tubing deployment/retrieval apparatus, the coiled tubing deployment/retrieval apparatus including: a) a frame; b) a coiled tubing guide coupled to the frame; c) a coiled tubing injector coupled to the frame, the coiled tubing injector configured to insert or retrieve a coiled tubing string guided by the coiled tubing guide into or out of a wellbore; and d) a power cable injector coupled to the frame, the power cable injector configured to insert or retrieve a power cable into or out of the wellbore alongside the coiled tubing string; and 2) a coiled tubing reel positioned proximate the coiled tubing deployment/retrieval apparatus, the coiled tubing reel including coiled tubing wound thereabout.

C. A method, the method including: 1) providing a coiled tubing surface equipment spread, the coiled tubing surface equipment spread including: a) a coiled tubing deployment/retrieval apparatus, the coiled tubing deployment/retrieval apparatus including; i) a frame; ii) a coiled tubing guide coupled to the frame; iii) a coiled tubing injector coupled to the frame, the coiled tubing injector configured to insert or retrieve a coiled tubing string guided by the coiled tubing guide into or out of the wellbore; and iv) a power cable injector coupled to the frame, the power cable injector configured to insert or retrieve a power cable into or out of the wellbore alongside the coiled tubing string; b) a coiled tubing reel positioned proximate the coiled tubing deployment/retrieval apparatus, the coiled tubing reel including coiled tubing wound thereabout; and c) a power cable reel positioned proximate the coiled tubing deployment/retrieval apparatus, the power cable reel including a power cable wound thereabout; and 2) operating the coiled tubing injector and the power cable injector in coordination to insert the coiled tubing string and the power cable within a wellbore or retrieve the coiled tubing string and the power cable from the wellbore.

D. A bottom hole assembly, the bottom hole assembly including: 1) a bottom hole assembly housing, the bottom hole assembly housing including an uphole end and a downhole end, the uphole end including a power cable connector configured to engage with a power cable; and 2) a tension measuring device associated with the bottom hole assembly housing, the tension measuring device configured to couple between the bottom hole assembly housing and the power cable to measure an amount of tension on the power cable proximate the bottom hole assembly housing.

E. A well system, the well system including: 1) a wellbore extending from a terranean surface through one or more subterranean formations; and 2) a bottom hole assembly located in the wellbore, the bottom hole assembly including: a) a bottom hole assembly housing, the bottom hole assembly housing including an uphole end and a downhole end, the uphole end including a power cable connector configured to engage with a power cable; and b) a tension measuring device associated with the bottom hole assembly housing, the tension measuring device configured to couple between the bottom hole assembly housing and the power cable to measure an amount of tension on the power cable proximate the bottom hole assembly housing.

F. A method, the method including: 1) positioning a bottom hole assembly within a wellbore extending from a terranean surface through one or more subterranean formations, the bottom hole assembly including: a) a bottom hole assembly housing, the bottom hole assembly housing including an uphole end and a downhole end, the uphole end including a power cable connector configured to engage with a power cable; and b) a tension measuring device associated with the bottom hole assembly housing, the tension measuring device configured to couple between the bottom hole assembly housing and the power cable to measure an amount of tension on the power cable proximate the bottom hole assembly housing; and 2) modulating a power cable rate upon which the power cable is insert within the wellbore based upon data obtained from the tension measuring device.

G. A surface equipment spread, the surface equipment spread including: 1) a frame; 2) a first injector coupled to the frame, the first tubing injector configured to insert or retrieve a first wellbore feature into or out of a wellbore; 3) a second injector coupled to the frame, the second injector configured to insert or retrieve a second wellbore feature into or out of the wellbore alongside the first wellbore feature; and 4) a control system coupled with the first injector, the control system configured to modulate a first rate upon which the first injector inserts the first wellbore feature within the wellbore or retrieves the first wellbore feature from the wellbore relative to a second rate upon which the second injector inserts the second wellbore feature within the wellbore or retrieves the second wellbore feature from the wellbore.

H. A well system, the well system including: 1) a wellbore extending through one or more subterranean formations; and 2) a coiled tubing surface equipment spread positioned over the wellbore, the coiled tubing surface equipment spread including: a) a frame; b) a first injector coupled to the frame, the first tubing injector configured to insert or retrieve a first wellbore feature into or out of a wellbore; c) a second injector coupled to the frame, the second injector configured to insert or retrieve a second wellbore feature into or out of the wellbore alongside the first wellbore feature; and d) a control system coupled with the first injector, the control system configured to modulate a first rate upon which the first injector inserts the first wellbore feature within the wellbore or retrieves the first wellbore feature from the wellbore relative to a second rate upon which the second injector inserts the second wellbore feature within the wellbore or retrieves the second wellbore feature from the wellbore.

I. A method, the method including: 1) providing a coiled tubing surface equipment spread, the coiled tubing surface equipment spread located over a wellbore of a well system, the coiled tubing surface equipment spread including: a) a frame; b) a first injector coupled to the frame, the first tubing injector configured to insert or retrieve a first wellbore feature into or out of a wellbore; c) a second injector coupled to the frame, the second injector configured to insert or retrieve a second wellbore feature into or out of the wellbore alongside the first wellbore feature; and d) a control system coupled with the first injector, the control system configured to modulate a first rate upon which the first injector inserts the first wellbore feature within the wellbore or retrieves the first wellbore feature from the wellbore relative to a second rate upon which the second injector inserts the second wellbore feature within the wellbore or retrieves the second wellbore feature from the wellbore; and 2) operating the first injector and the second injector in coordination to insert the first wellbore feature and the second wellbore feature within the wellbore or retrieve the first wellbore feature and the second wellbore feature from the wellbore.

Aspects A, B, C, D, E, F, G, H and I may have one or more of the following additional elements in combination: Element 1: further including a power cable guide coupled to the frame, the power cable injector configured to insert or retrieve the power cable guided by the power cable guide into or out of the wellbore alongside the coiled tubing string. Element 2: further including a coiled tubing stripper associated with the coiled tubing injector. Element 3: further including a power cable stripper associated with the power cable injector. Element 4: wherein the coiled tubing stripper and the power cable stripper form at least a portion of an integrated stripper associated with both the coiled tubing string and the power cable. Element 5: wherein a coiled tubing seal of the coiled tubing stripper and a power cable seal of the power cable stripper are parallel with one another. Element 6: wherein a coiled tubing seal of the coiled tubing stripper and a power cable seal of the power cable stripper are angled relative to one another. Element 7: further including a power cable control system coupled with the power cable injector, the power cable control system configured to modulate a power cable rate upon which the power cable injector inserts the power cable within the wellbore or retrieves the power cable from the wellbore relative to a coiled tubing rate upon which the coiled tubing injector inserts the coiled tubing string within the wellbore or retrieves the coiled tubing string from the wellbore. Element 8: wherein the power cable control system includes a tension measuring device associated with the power cable, the tension measuring device configured to measure an amount of tension or compression on the power cable as the power cable injector inserts the power cable within the wellbore or retrieves the power cable from the wellbore, the power cable control system configured to modulate the power cable rate upon which the power cable injector inserts the power cable within the wellbore or retrieves the power cable from the wellbore based upon data obtained from the tension measuring device. Element 9: wherein the tension measuring device is a load cell. Element 10: further including a bottom hole assembly (BHA) coupled to both of the coiled tubing string and the power cable, the bottom hole assembly (BHA) including a bottom hole assembly (BHA) housing, the bottom hole assembly (BHA) housing including an uphole end and a downhole end, the uphole end including a coiled tubing connector engaging with the coiled tubing string and a power cable connector engaging with the power cable, wherein the tension measuring device is associated with the bottom hole assembly (BHA) housing, the tension measuring device configured to couple between the bottom hole assembly (BHA) housing and the power cable to measure the amount of tension or compression on the power cable proximate the bottom hole assembly (BHA) housing. Element 11: further including a coiled tubing string control system coupled with the coiled tubing injector, the coiled tubing string control system configured to modulate the coiled tubing rate upon which the coiled tubing injector inserts the coiled tubing string within the wellbore or retrieves the coiled tubing string from the wellbore relative to the power cable rate upon which the power cable injector inserts the power cable within the wellbore or retrieves the power cable from the wellbore. Element 12: wherein the tension measuring device is a first tension measuring device, and further wherein the bottom hole assembly (BHA) includes a second tension measuring device associated with the bottom hole assembly (BHA) housing, the second tension measuring device configured to couple between the bottom hole assembly (BHA) housing and the coiled tubing connector to measure an amount of tension or compression on the coiled tubing string proximate the bottom hole assembly (BHA) housing. Element 13: wherein no two clamps fixing the coiled tubing string and power cable together are positioned within 50 m from one another. Element 14: further including a power cable reel positioned proximate the coiled tubing deployment/retrieval apparatus, the power cable reel including a power cable wound thereabout. Element 15: wherein the coiled tubing extends over the coiled tubing guide, the coiled tubing guide guiding the coiled tubing within the coiled tubing injector. Element 16: further including a power cable guide coupled to the frame, the power cable injector configured to insert or retrieve the power cable guided by the power cable guide into or out of the wellbore alongside the coiled tubing string. Element 17: wherein the power cable extends over the power cable guide, the power cable guide guiding the power cable within the power cable injector. Element 18: wherein the coiled tubing surface equipment spread further includes a power cable control system coupled with the power cable injector, and further wherein the operating includes using the power cable control system to modulate a power cable rate upon which the power cable injector inserts the power cable within the wellbore or retrieves the power cable from the wellbore relative to a coiled tubing rate upon which the coiled tubing injector inserts the coiled tubing string within the wellbore or retrieves the coiled tubing string from the wellbore. Element 19: wherein the power cable control system includes a tension measuring device associated with the power cable, the tension measuring device configured to measure an amount of tension or compression on the power cable as the power cable injector inserts the power cable within the wellbore or retrieves the power cable from the wellbore, and further wherein the operating includes using the power cable control system to modulate the power cable rate upon which the power cable injector inserts the power cable within the wellbore or retrieves the power cable from the wellbore relative to the coiled tubing rate upon which the coiled tubing injector inserts the coiled tubing string within the wellbore or retrieves the coiled tubing string from the wellbore based upon data obtained from the tension measuring device. Element 20: wherein the uphole end of the bottom hole assembly housing further includes a coiled tubing connector configured to engage with a coiled tubing string. Element 21: wherein the tension measuring device is a load cell. Element 22: wherein the load cell is located between the power cable connector and the power cable the power cable connector is configured to engage with. Element 23: further including a pulsed power drill bit located proximate a downhole end of the bottom hole assembly housing, the pulsed power drill bit configured to generate an electrical arc sufficient to form a wellbore when downhole. Element 24: wherein the uphole end of the bottom hole assembly housing further includes a coiled tubing connector configured to engage with a coiled tubing string. Element 25: wherein the coiled tubing connector is coupled with a coiled tubing string and the power cable connector is coupled with a power cable. Element 26: wherein the tension measuring device is a load cell configured to measure tension on the power cable. Element 27: wherein the load cell is coupled between the power cable connector and the power cable. Element 28: further including a pulsed power drill bit located proximate a downhole end of the bottom hole assembly housing, the pulsed power drill bit configured to generate an electrical arc sufficient to form a wellbore when downhole. Element 29: further including a coiled tubing surface equipment spread located at the terranean surface over the wellbore, the coiled tubing surface equipment spread including: a frame; a coiled tubing guide coupled to the frame; a coiled tubing injector coupled to the frame; and a power cable injector coupled to the frame, the power cable injector configured to insert the power cable into the wellbore or retrieve the power cable from the wellbore alongside the coiled tubing string. Element 30: wherein the coiled tubing string is located in the coiled tubing injector and the power cable is located in the power cable injector. Element 31: further including a power cable control system coupled with the power cable injector, the power cable control system configured to modulate a power cable rate upon which the power cable injector inserts the power cable within the wellbore based upon data obtained from the tension measuring device. Element 32: wherein the power cable control system is a coiled tubing and power cable control system, the coiled tubing and power cable control system configured to modulate the power cable rate upon which the power cable injector inserts the power cable within the wellbore, and modulate a coiled tubing rate upon which the coiled tubing injector inserts the coiled tubing within the wellbore, both the power cable rate and the coiled tubing rate based upon the data obtained from the tension measuring device. Element 33: wherein the data is tension data relating to tension on the power cable. Element 34: wherein the tension measuring device is a first tension measuring device, and further wherein the bottom hole assembly includes a second tension measuring device associated with the bottom hole assembly housing, the second tension measuring device configured to couple between the bottom hole assembly housing and the coiled tubing connector to measure an amount of tension on the coiled tubing proximate the bottom hole assembly housing. Element 35: further including a coiled tubing surface equipment spread located at the terranean surface over the wellbore, the coiled tubing surface equipment spread including: a frame; a coiled tubing guide coupled to the frame; a coiled tubing injector coupled to the frame; and a power cable injector coupled to the frame, the power cable injector configured to insert the power cable into the wellbore or retrieve the power cable from the wellbore alongside the coiled tubing string. Element 36: further including a power cable control system coupled with the power cable injector, the power cable control system modulating the power cable rate upon which the power cable injector inserts the power cable within the wellbore based upon tension data obtained from the tension measuring device. Element 37: wherein the first injector is a first tubular injector and the second injector is a second tubular injector. Element 38: wherein the first injector is a first coiled tubing injector. Element 39: wherein at least one of the first injector or the second injector is a coiled tubing injector. Element 40: wherein the first injector is a power cable injector, the first wellbore feature is a power cable, the second injector is a coiled tubing injector, and the second wellbore feature is a coiled tubing string. Element 41: wherein the control system is a power cable control system coupled with the power cable injector, the power cable control system configured to modulate a power cable rate upon which the power cable injector inserts the power cable within the wellbore or retrieves the power cable from the wellbore relative to a coiled tubing rate upon which the coiled tubing injector inserts the coiled tubing string within the wellbore or retrieves the coiled tubing string from the wellbore. Element 42: wherein the power cable control system includes a tension measuring device associated with the power cable, the tension measuring device configured to measure an amount of tension or compression on the power cable as the power cable injector inserts the power cable within the wellbore or retrieves the power cable from the wellbore, the power cable control system configured to modulate the power cable rate upon which the power cable injector inserts the power cable within the wellbore or retrieves the power cable from the wellbore based upon data obtained from the tension measuring device. Element 43: further including a coiled tubing string control system coupled with the coiled tubing injector, the coiled tubing string control system configured to modulate the coiled tubing rate upon which the coiled tubing injector inserts the coiled tubing string within the wellbore or retrieves the coiled tubing string from the wellbore relative to the power cable rate upon which the power cable injector inserts the power cable within the wellbore or retrieves the power cable from the wellbore. Element 44: wherein the tension measuring device is a load cell. Element 45: wherein at least one of the first wellbore feature or the second wellbore feature is jointed pipe.

Those skilled in the art to which this application relates will appreciate that other and further additions, deletions, substitutions and modifications may be made to the described examples.

What is claimed is:

1. A coiled tubing deployment/retrieval apparatus, comprising:

a frame;

a coiled tubing guide coupled to the frame;

a coiled tubing injector coupled to the frame, the coiled tubing injector configured to insert or retrieve a coiled tubing string guided by the coiled tubing guide into or out of a wellbore; and a power cable injector rigidly mounted to the frame, the power cable injector configured to insert or retrieve a power cable into or out of the wellbore alongside the coiled tubing string.

2. The coiled tubing deployment/retrieval apparatus as recited in claim 1, further including a power cable guide coupled to the frame, the power cable injector configured to insert or retrieve the power cable guided by the power cable guide into or out of the wellbore alongside the coiled tubing string.

3. The coiled tubing deployment/retrieval apparatus as recited in claim 1, further including a coiled tubing stripper associated with the coiled tubing injector.

4. The coiled tubing deployment/retrieval apparatus as recited in claim 3, further including a power cable stripper associated with the power cable injector.

5. The coiled tubing deployment/retrieval apparatus as recited in claim 4, wherein the coiled tubing stripper and the power cable stripper form at least a portion of an integrated stripper associated with both the coiled tubing string and the power cable.

6. The coiled tubing deployment/retrieval apparatus as recited in claim 5, wherein a coiled tubing seal of the coiled tubing stripper and a power cable seal of the power cable stripper are parallel with one another.

7. The coiled tubing deployment/retrieval apparatus as recited in claim 5, wherein a coiled tubing seal of the coiled tubing stripper and a power cable seal of the power cable stripper are angled relative to one another.

8. The coiled tubing surface equipment spread as recited in claim 1, further including a power cable control system coupled with the power cable injector, the power cable control system configured to modulate a power cable rate upon which the power cable injector inserts the power cable within the wellbore or retrieves the power cable from the wellbore relative to a coiled tubing rate upon which the coiled tubing injector inserts the coiled tubing string within the wellbore or retrieves the coiled tubing string from the wellbore.

9. The coiled tubing surface equipment spread as recited in claim 8, wherein the power cable control system includes a tension measuring device associated with the power cable, the tension measuring device configured to measure an amount of tension or compression on the power cable as the power cable injector inserts the power cable within the wellbore or retrieves the power cable from the wellbore, the power cable control system configured to modulate the power cable rate upon which the power cable injector inserts the power cable within the wellbore or retrieves the power cable from the wellbore based upon data obtained from the tension measuring device.

10. The coiled tubing surface equipment spread as recited in claim 9, wherein the tension measuring device is a load cell.

11. A coiled tubing surface equipment spread, comprising:

a coiled tubing deployment/retrieval apparatus, the coiled tubing deployment/retrieval apparatus including:

a frame;

a coiled tubing guide coupled to the frame;

a coiled tubing injector coupled to the frame, the coiled tubing injector configured to insert or retrieve a coiled tubing string guided by the coiled tubing guide into or out of a wellbore; and a power cable injector rigidly mounted to the frame, the power cable injector configured to insert or retrieve a power cable into or out of the wellbore alongside the coiled tubing string; and a coiled tubing reel positioned proximate the coiled tubing deployment/retrieval apparatus, the coiled tubing reel including coiled tubing wound thereabout.

12. The coiled tubing surface equipment spread as recited in claim 11, further including a power cable reel positioned proximate the coiled tubing deployment/retrieval apparatus, the power cable reel including a power cable wound thereabout.

13. The coiled tubing surface equipment spread as recited in claim 12, wherein the coiled tubing extends over the coiled tubing guide, the coiled tubing guide guiding the coiled tubing within the coiled tubing injector.

14. The coiled tubing surface equipment spread as recited in claim 13, further including a power cable guide coupled to the frame, the power cable injector configured to insert or retrieve the power cable guided by the power cable guide into or out of the wellbore alongside the coiled tubing string.

15. The coiled tubing surface equipment spread as recited in claim 14, wherein the power cable extends over the power cable guide, the power cable guide guiding the power cable within the power cable injector.

16. The coiled tubing surface equipment spread as recited in claim 11, further including a power cable control system coupled with the power cable injector, the power cable control system configured to modulate a power cable rate upon which the power cable injector inserts the power cable within the wellbore or retrieves the power cable from the wellbore relative to a coiled tubing rate upon which the coiled tubing injector inserts the coiled tubing string within the wellbore or retrieves the coiled tubing string from the wellbore.

17. The coiled tubing surface equipment spread as recited in claim 16, wherein the power cable control system includes a tension measuring device associated with the power cable, the tension measuring device configured to measure an amount of tension or compression on the power cable as the power cable injector inserts the power cable within the wellbore or retrieves the power cable from the wellbore, the power cable control system configured to modulate the power cable rate upon which the power cable injector inserts the power cable within the wellbore or retrieves the power cable from the wellbore based upon data obtained from the tension measuring device.

18. The coiled tubing surface equipment spread as recited in claim 17, wherein the tension measuring device is a load cell.

19. The coiled tubing surface equipment spread as recited in claim 17, further including a bottom hole assembly (BHA) coupled to both of the coiled tubing string and the power cable, the bottom hole assembly (BHA) including a bottom hole assembly (BHA) housing, the bottom hole assembly (BHA) housing including an uphole end and a downhole end, the uphole end including a coiled tubing connector engaging with the coiled tubing string and a power cable connector engaging with the power cable, wherein the tension measuring device is associated with the bottom hole assembly (BHA) housing, the tension measuring device configured to couple between the bottom hole assembly (BHA) housing and the power cable to measure the amount of tension or compression on the power cable proximate the bottom hole assembly (BHA) housing.

20. The coiled tubing surface equipment spread as recited in claim 19, wherein the tension measuring device is a first tension measuring device, and further wherein the bottom hole assembly (BHA) includes a second tension measuring device associated with the bottom hole assembly (BHA) housing, the second tension measuring device configured to couple between the bottom hole assembly (BHA) housing and the coiled tubing connector to measure an amount of tension or compression on the coiled tubing string proximate the bottom hole assembly (BHA) housing.

21. The coiled tubing surface equipment spread as recited in claim 16, further including a coiled tubing string control system coupled with the coiled tubing injector, the coiled tubing string control system configured to modulate the coiled tubing rate upon which the coiled tubing injector inserts the coiled tubing string within the wellbore or retrieves the coiled tubing string from the wellbore relative to the power cable rate upon which the power cable injector inserts the power cable within the wellbore or retrieves the power cable from the wellbore.

22. A method, comprising:

providing a coiled tubing surface equipment spread, the coiled tubing surface equipment spread including:

a coiled tubing deployment/retrieval apparatus, the coiled tubing deployment/retrieval apparatus including;

a frame;

a coiled tubing guide coupled to the frame;

a coiled tubing injector coupled to the frame, the coiled tubing injector configured to insert or retrieve a coiled tubing string guided by the coiled tubing guide into or out of the wellbore; and a power cable injector rigidly mounted to the frame, the power cable injector configured to insert or retrieve a power cable into or out of the wellbore alongside the coiled tubing string;

a coiled tubing reel positioned proximate the coiled tubing deployment/retrieval apparatus, the coiled tubing reel including coiled tubing wound thereabout; and a power cable reel positioned proximate the coiled tubing deployment/retrieval apparatus, the power cable reel including a power cable wound thereabout; and operating the coiled tubing injector and the power cable injector in coordination to insert the coiled tubing string and the power cable within a wellbore or retrieve the coiled tubing string and the power cable from the wellbore.

23. The method as recited in claim 22, wherein the coiled tubing surface equipment spread further includes a power cable control system coupled with the power cable injector, and further wherein the operating includes using the power cable control system to modulate a power cable rate upon which the power cable injector inserts the power cable within the wellbore or retrieves the power cable from the wellbore relative to a coiled tubing rate upon which the coiled tubing injector inserts the coiled tubing string within the wellbore or retrieves the coiled tubing string from the wellbore.

24. The method as recited in claim 23, wherein the power cable control system includes a tension measuring device associated with the power cable, the tension measuring device configured to measure an amount of tension or compression on the power cable as the power cable injector inserts the power cable within the wellbore or retrieves the power cable from the wellbore, and further wherein the operating includes using the power cable control system to modulate the power cable rate upon which the power cable injector inserts the power cable within the wellbore or retrieves the power cable from the wellbore relative to the coiled tubing rate upon which the coiled tubing injector inserts the coiled tubing string within the wellbore or retrieves the coiled tubing string from the wellbore based upon data obtained from the tension measuring device.

25. A coiled tubing deployment/retrieval apparatus, comprising:

a frame;

a coiled tubing guide coupled to the frame;

a coiled tubing injector coupled to the frame, the coiled tubing injector configured to insert or retrieve a coiled tubing string guided by the coiled tubing guide into or out of a wellbore, and having a coiled tubing stripper associated therewith;

a power cable injector coupled to the frame, the power cable injector configured to insert or retrieve a power cable into or out of the wellbore alongside the coiled tubing string, and having a power cable stripper associated therewith, wherein the coiled tubing stripper and the power cable stripper form at least a portion of an integrated stripper associated with both the coiled tubing string and the power cable.

26. A coiled tubing deployment/retrieval apparatus, comprising:

a frame;

a coiled tubing guide coupled to the frame;

a coiled tubing injector coupled to the frame, the coiled tubing injector configured to insert or retrieve a coiled tubing string guided by the coiled tubing guide into or out of a wellbore;

a power cable injector coupled to the frame, the power cable injector configured to insert or retrieve a power cable into or out of the wellbore alongside the coiled tubing string; and a power cable control system coupled with the power cable injector, the power cable control system configured to modulate a power cable rate upon which the power cable injector inserts the power cable within the wellbore or retrieves the power cable from the wellbore relative to a coiled tubing rate upon which the coiled tubing injector inserts the coiled tubing string within the wellbore or retrieves the coiled tubing string from the wellbore, wherein the power cable control system includes a tension measuring device associated with the power cable, the tension measuring device configured to measure an amount of tension or compression on the power cable as the power cable injector inserts the power cable within the wellbore or retrieves the power cable from the wellbore, the power cable control system configured to modulate the power cable rate upon which the power cable injector inserts the power cable within the wellbore or retrieves the power cable from the wellbore based upon data obtained from the tension measuring device.

27. A method, comprising:

providing a coiled tubing surface equipment spread, the coiled tubing surface equipment spread including:

a coiled tubing deployment/retrieval apparatus, the coiled tubing deployment/retrieval apparatus including;

a frame;

a coiled tubing guide coupled to the frame;

a coiled tubing injector coupled to the frame, the coiled tubing injector configured to insert or retrieve a coiled tubing string guided by the coiled tubing guide into or out of the wellbore; and a power cable injector coupled to the frame, the power cable injector configured to insert or retrieve a power cable into or out of the wellbore alongside the coiled tubing string;

a coiled tubing reel positioned proximate the coiled tubing deployment/retrieval apparatus, the coiled tubing reel including coiled tubing wound thereabout; and a power cable reel positioned proximate the coiled tubing deployment/retrieval apparatus, the power cable reel including a power cable wound thereabout; and operating the coiled tubing injector and the power cable injector in coordination to insert the coiled tubing string and the power cable within a wellbore or retrieve the coiled tubing string and the power cable from the wellbore, wherein the coiled tubing surface equipment spread further includes a power cable control system coupled with the power cable injector, and further wherein the operating includes using the power cable control system to modulate a power cable rate upon which the power cable injector inserts the power cable within the wellbore or retrieves the power cable from the wellbore relative to a coiled tubing rate upon which the coiled tubing injector inserts the coiled tubing string within the wellbore or retrieves the coiled tubing string from the wellbore, wherein the power cable control system includes a tension measuring device associated with the power cable, the tension measuring device configured to measure an amount of tension or compression on the power cable as the power cable injector inserts the power cable within the wellbore or retrieves the power cable from the wellbore, and further wherein the operating includes using the power cable control system to modulate the power cable rate upon which the power cable injector inserts the power cable within the wellbore or retrieves the power cable from the wellbore relative to the coiled tubing rate upon which the coiled tubing injector inserts the coiled tubing string within the wellbore or retrieves the coiled tubing string from the wellbore based upon data obtained from the tension measuring device.

* * * * *